US005540455A

United States Patent [19]

Chambers

[11] Patent Number: 5,540,455

[45] Date of Patent: Jul. 30, 1996

[54] ARTICULATING SKATEBOARD WITH SPRINGABLE CONNECTOR

[76] Inventor: Lile R. Chambers, P.O. Box 1047, Aztec, N.M. 87410

[21] Appl. No.: 200,482

[22] Filed: Feb. 23, 1994

[51] Int. Cl.[6] ..... A63C 17/02

[52] U.S. Cl. ..... 280/87.042; 280/87.041; 280/11.28

[58] Field of Search ..... 280/87.041, 87.042, 280/87.03, 11.28, 11.27, 14.2

[56] References Cited

U.S. PATENT DOCUMENTS

| | | | |
|---|---|---|---|
| 1,377,948 | 5/1921 | Wacker . | |
| 1,483,033 | 2/1924 | Wisman | 280/87.041 |
| 2,162,128 | 6/1939 | Shoemaker . | |
| 3,023,022 | 2/1962 | Boyden . | |
| 3,309,104 | 3/1967 | Gold | 280/87.041 |
| 3,620,547 | 11/1971 | Vaverek . | |
| 3,667,777 | 6/1972 | Enriquez | 280/87.042 |
| 3,771,811 | 11/1973 | Bueno . | |
| 3,891,225 | 6/1975 | Sessa | 280/87.041 |
| 3,954,279 | 5/1976 | Guerr | 280/87.042 |
| 4,029,330 | 6/1977 | Runyan | 280/87.042 |
| 4,076,267 | 2/1978 | Lipscomb | 280/87.042 |
| 4,082,306 | 4/1978 | Sheldon | 280/87.042 |
| 4,120,508 | 10/1978 | Brown et al. | 280/87.042 |
| 4,120,510 | 10/1978 | Hillard | 280/87.042 |
| 4,155,565 | 5/1979 | de Caussin et al. | 280/87.042 |
| 4,161,323 | 7/1979 | Wetteland | 280/87.042 |
| 4,163,565 | 8/1979 | Weber | 280/87.042 |
| 4,165,089 | 8/1979 | Urdea | 280/87.042 |
| 4,195,857 | 4/1980 | Hechinger | 280/87.042 |
| 4,202,559 | 5/1980 | Piazza . | |
| 4,274,647 | 6/1981 | Drake | 280/87.042 |
| 4,295,656 | 10/1981 | Moore . | |
| 4,353,566 | 10/1982 | Mohlenbrock . | |
| 4,458,907 | 7/1984 | Meredith . | |
| 4,555,122 | 11/1985 | Harvey | 280/87.041 |
| 4,645,223 | 2/1987 | Grossman | 280/11.28 |
| 4,681,333 | 7/1987 | Rouge et al. . | |
| 4,861,054 | 8/1989 | Spital | 280/87.042 |
| 4,886,298 | 12/1989 | Shols | 280/87.042 |
| 4,955,626 | 9/1990 | Smith et al. | 280/87.042 |
| 5,090,716 | 2/1992 | Borden | 280/87.042 |
| 5,096,225 | 3/1992 | Osawa | 280/842 |
| 5,154,436 | 10/1992 | Jez et al. | 280/87.042 |
| 5,236,208 | 8/1993 | Welsh | 280/87.041 |

FOREIGN PATENT DOCUMENTS

| | | | |
|---|---|---|---|
| 0814256 | 12/1951 | Germany | 280/87.041 |
| 1050723 | 10/1983 | U.S.S.R. | 280/11.28 |
| 1289518 | 2/1987 | U.S.S.R. | 280/11.28 |
| 1405865A | 6/1988 | U.S.S.R. . | |
| 1166219 | 10/1969 | United Kingdom . | |
| 9206753 | 4/1992 | WIPO | 280/87.042 |

*Primary Examiner*—Brian L. Johnson

*Attorney, Agent, or Firm*—Maxwell C. Freudenberg; Kenton L. Freudenberg

[57] ABSTRACT

An articulated skateboard having two or three separate platform sections connected end-to-end with conventional skate wheel trucks under the end platform sections. The articulation structure between platform sections comprises a combination of pivoting and resilient spring members enabling universal angular flexing which absorb and return heavy vertical forces during jumping skateboard maneuvers and provide relatively lighter resilient flexibility to permit relative horizontal angular movement between platform sections to facilitate steering maneuvers in response to foot actuation of the platform sections. Pivoting action in the articulation structure is about a pivot axis at an angle of 45 degrees to the horizontal and in a vertical plane containing the front-to-rear direction of the skateboard.

23 Claims, 9 Drawing Sheets

Fig. 3
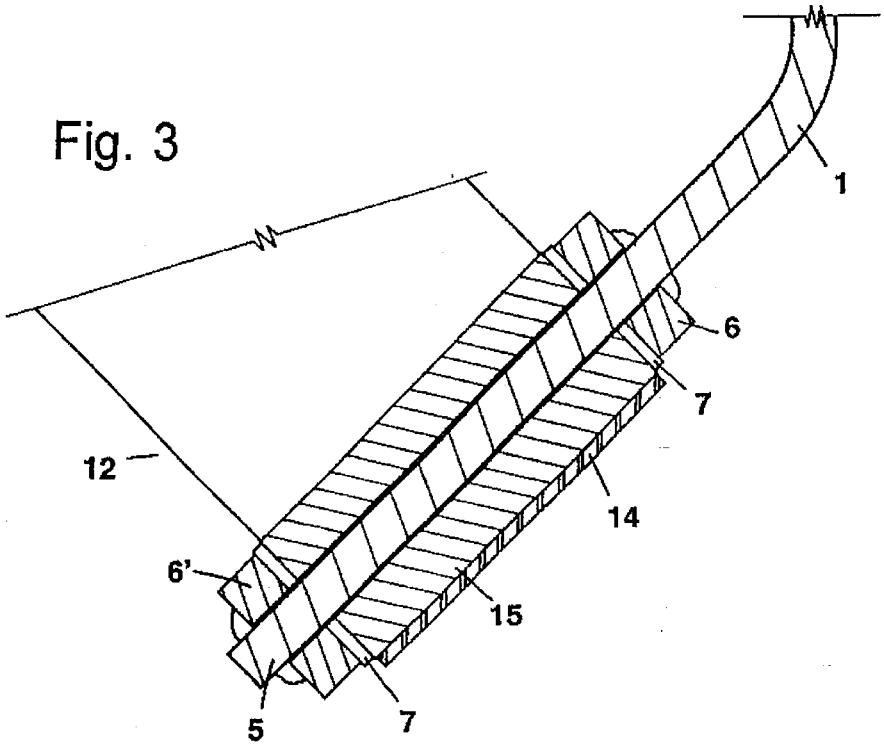
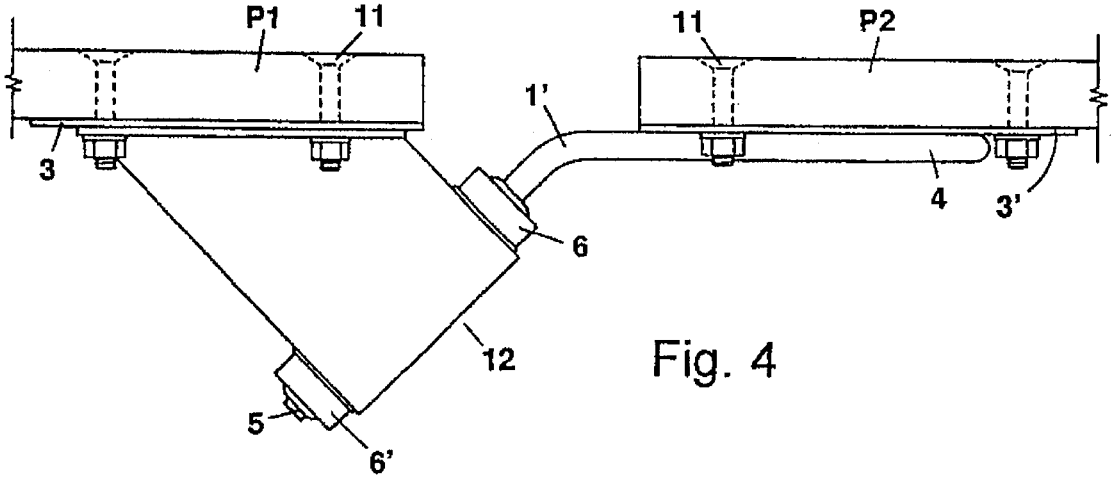
Fig. 4

ARTICULATING SKATEBOARD WITH SPRINGABLE CONNECTOR

BACKGROUND OF THE INVENTION

A typical or standard skateboard used for recreational purposes comprises a generally elongated flat platform on which the user or rider stands and wheel assemblies or trucks mounted below the platform. While the axles upon which the wheels rotate are normally parallel to one another and perpendicular to the longitudinal axis of the platform, the trucks are provided with a pivot axis which is angled with respect to the platform so that tilting of the platform about its longitudinal axis, which extends in the direction of normal rolling movement, results in pivoting or steering movement of the wheels about a vertical axis. These "steerable" trucks allow the rider to use side-to-side tilting of the platform to steer or control the board. Tilting the board to steer has the additional advantage of facilitating the balance of the rider by providing a platform which is effectively "banked" into the turn to compensate for the centrifugal force encountered during the turn. Because of the unitary nature of a typical platform the wheel trucks are not independently steerable, that is, one set of trucks cannot be steered without steering the other as well. The present invention provides an articulating connector to allow independent movement between two respective board platforms and the respective trucks.

Skilled skateboard riders often perform tricks and stunts in which the rider, the board, or both may leave the ground. To facilitate such activities, it may be desirable to incorporate a degree of "springiness" or "liveliness" into a board. While unitary platforms of boards are often constructed from resilient materials such as impregnated fiberglass or similar composites, such a construction creates a board with a relatively fixed degree of resilience controlling vertical bending and does not generally provide for independent transverse relative steering movement of the front and rear portions of the board.

U.S. Pat. No. 4,076,267 to Lipscomb describes a skateboard with separate sections which are independently pivotable about a common longitudinally extending horizontal axis and which are connected together at a center point through a similarly oriented horizontal pivot axis. U.S. Pat. No. 4,082,306 to Sheldon describes a skateboard somewhat similar to that of Lipscomb, in which two respective end platforms are independently pivotable about a horizontal axis and are connected by a longitudinally extending torsion bar. U.S. Pat. No. 4,955,626 to Smith et al. describes a skateboard with separately pivotable end platform sections, each being pivotable about it own vertical axis located at a respective end of a longitudinal connecting member between the end platform sections. It must be noted that when using such a vertical axis with respective platform portions, which are normally oriented in the same plane, sufficient space must be provided between the two platforms so that there is no interference between the platforms as they are pivoted with respect to one another.

SUMMARY OF THE INVENTION

The present invention incorporates articulating means comprising coiled steel springs or other similar springs use to interconnect two sections of a skateboard platform to provide relative universal articulating movement between the platform sections. The springs are further capable of being changed relatively easily to provide a variation in the degree of resilience and related vertical flexibility of the board while also providing a means of effectively horizontally and transversely articulating the board about more than one axis for steering and maneuvering functions. The invention further comprises a novel structure for connecting two portions of a skateboard platform comprising a spring as previously described in combination with a pivot structure in which the pivot axis is angled at approximately 45 degrees with respect to the board platforms and lies within a vertical plane which passes through the longitudinal axis of the board. This combination is intended to provide the benefits of an articulated skateboard along with the benefits of a resilient skateboard. The use of a coil spring as a connector between board halves provides the additional benefit of allowing the coil or loop of the spring to be used as a convenient point of attachment of a rider-held leash, rope or any other similar device near the center of the board to hold the board against the soles of the rider's feet during acrobatic board maneuvers.

It is an object of the present invention to provide an articulated skateboard to allow independent, tilting or steering control of the respective end portions of the board.

It is an object of the present invention to provide an articulated skateboard which effectively allows independent movement of each respective end portion of the board about both a horizontal axis and a vertical axis.

It is an object of the present invention to provide an improved flexible skateboard to facilitate jumping.

Another object of the invention is to enable vertical flexibility and horizontally transverse articulation to be separately selected by different design parameters of a common articulating spring structure interconnecting two separate platform sections of a skateboard, thus enabling resilient resistance to substantial vertical forces during jumping maneuvers while also enabling lesser resilient resistance to horizontal relative movement of the platform sections by foot actuation to facilitate steering maneuvers.

It is an object of the present invention to provide an improved detachable means of resiliently biasing two skateboard sections relative to each other.

It is an object of the present invention to provide a connector for two skateboard halves which provides for articulating movement between the halves.

It is an object of the present invention to provide a connector between adjacent pairs of two or more skateboard sections which provides for articulating movement between the sections of each adjacent pair.

It is an object of the present invention to provide a skateboard with a convenient point of attachment for a leash.

DESCRIPTION OF THE DRAWINGS

FIG. 3 is cross sectional view of the pivot assembly of the preferred embodiment.

FIG. 4 is a side view of the articulation assembly of an alternative embodiment similar to FIG. 2, but in which a rigid bent rod is used in place of a coil spring.

DESCRIPTION OF THE PREFERRED EMBODIMENT

Figure 1:
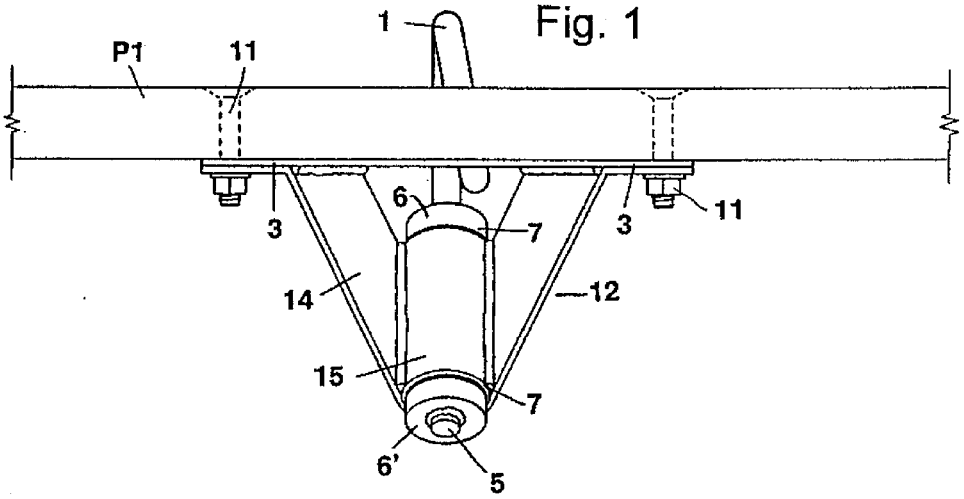
FIG. 1 is an end view of the articulation assembly of the preferred embodiment showing a coiled spring articulating connection with an angularly oriented pivot assembly for one end of the spring.
Figure 2:
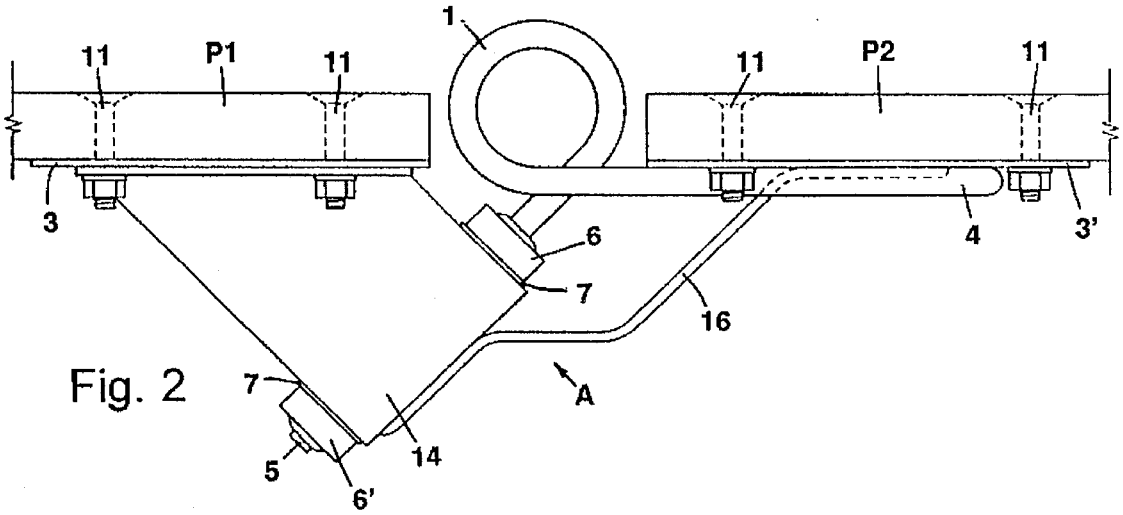
FIG. 2 is a side view of the articulation assembly of the preferred embodiment.

The preferred embodiment of the present invention as seen most clearly in FIGS. 1–2 comprises two independent skateboard platforms P1 and P2 connected by a spring and pivot assembly A. Each of the platform sections P1 and P2 has a broad flat upper surface area on which a skateboard rider can place at least one of his feet. Respective wheel set assemblies are attached to the under side of each platform section at locations similar to the wheel assemblies of FIG. 5–9 to provide rolling support for the platforms. The spring 1 is a coiled spring of one or more coils fashioned from appropriate round spring steel rod and provided with a coil diameter of approximately one inch.

Figure 15A:
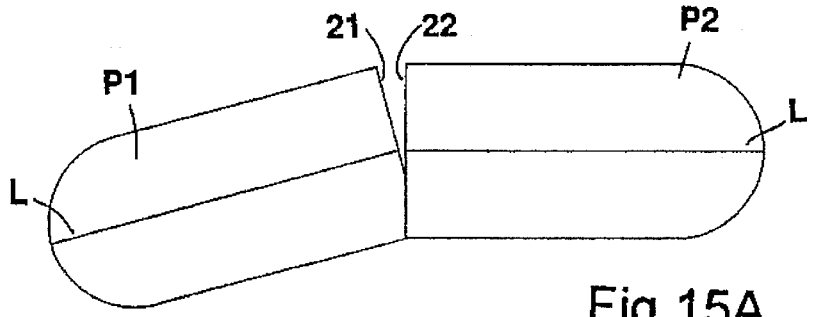
FIGS. 15A and 15B illustrate how generally parallel adjacent edge portions of the platform sections of different embodiments can be made to slightly overlap one another as the skateboard is turned in opposite directions.
Figure 15B:
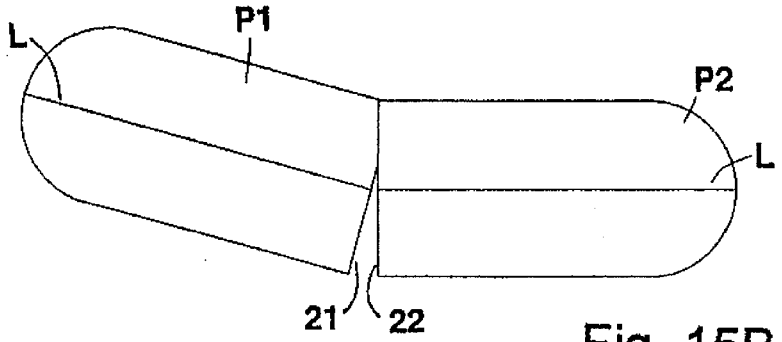

As shown in FIG. 2, the rod is formed into a coil of slightly less than one full turn. The angle between the respective ends as shown is approximately 135 degrees, corresponding to the angle of the pivot housing which is oriented approximately 45 degrees from the plane of the platforms. By orienting the pivot housing at an angle which is neither completely horizontal nor completely vertical, any relative movement of the platforms about their common pivot point has simultaneous components about both a horizontal axis and about a vertical axis. For example, assuming that the front portion of a skateboard is at the left side of the structure shown in FIG. 2, the respective movements of tilting the left side of the front platform down as would be viewed from the front of the board (as is seen in FIG. 1) or angling the front portion to the left (as is seen in FIG. 15A) take place simultaneously. As the platform portions are pivoted they do not remain parallel and coplanar. Because of this movement, little horizontal space is required between the platform portions except to accommodate the coil of spring 1. If the platforms are not excessively thick in vertical extent the edges 21 and 22 of the platforms may be made to actually overlap one another without interference, as shown in FIGS. 15A and 15B, in which case central portions of the platform sections may be cut away (not illustrated) to accommodate the coiled portion of the spring 1 or used as illustrated with the bent rod 1' of FIG. 4.

An extended straight portion of a first end 4 of the spring rod is permanently secured as by welding to a flat plate 3'. Plate 3' is eventually bolted or otherwise affixed to platform P2 using, for example, fasteners such as a nut and bolt combination 11. The opposite end 5 of the spring rod is kept straight to serve as a pivot axle within the pivot housing assembly 12 which is mounted to the second platform P1. This end 5 of the rod is fitted with a permanent collar 6. After forming the spring assembly comprising spring 1, plate 3' and collar 6, the entire assembly is subjected to a heat treatment well known in the art of making springs to give the coil spring its resilient properties.

The pivot housing assembly 12 comprises a support 14 of stamped sheet steel which holds a tubing or sleeve section 15. The sleeve serves as a bearing to receive the rod end 5. The entire assembly 12 is further attached to the platform P2 using plate 3' in the same manner as plate 3, forming part of the pivot housing 12, is attached to platform P1.

With plates 3 and 3' affixed to their respective platforms, rod end 5 is inserted into the sleeve 15 and secured using a second collar 6'. Plastic or metal washers 7 are positioned on rod between the pivot housing and the respective collars 6 and 6' to help reduce friction during rotational movement of the rod 5 within sleeve 15. While it is not required, as shown in FIG. 2 an alignment brace 16 comprising a formed rod of spring material may be attached between the respective platforms P1 and P2 by being welded or otherwise affixed to the pivot housing assembly 12 and plate 3' on the opposite platform. This alignment brace 16 provides a biasing tension to create a "self-centering" effect causing the respective platforms P1 and P2 to return to the neutral and aligned orientations shown in FIGS. 5, 8 and 14A.

Alternatively, a bent rod 1' made of spring material, as seen in FIG. 4 may be used in place of the coil spring to give vertical resiliency or flexibility to the center of the board. To the extent that the springing action is not needed, the bent rod 1' may be formed of an essentially rigid material so that the benefits of independent pivoting of the respective platforms are retained. A springing alignment brace 16 as shown in FIG. 2 may also be used with the structure shown in FIG. 4.

Figure 5:
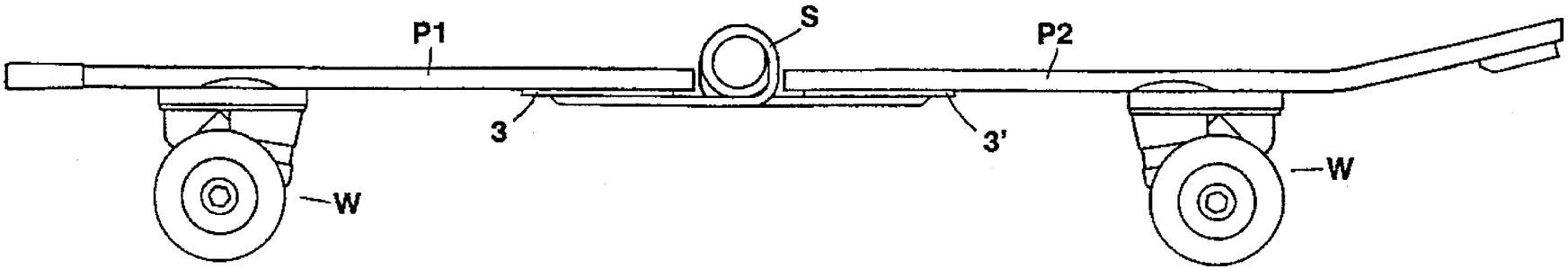
FIG. 5 is a side view of the skateboard of another alternative embodiment in its normal unstressed configuration.
Figure 6:
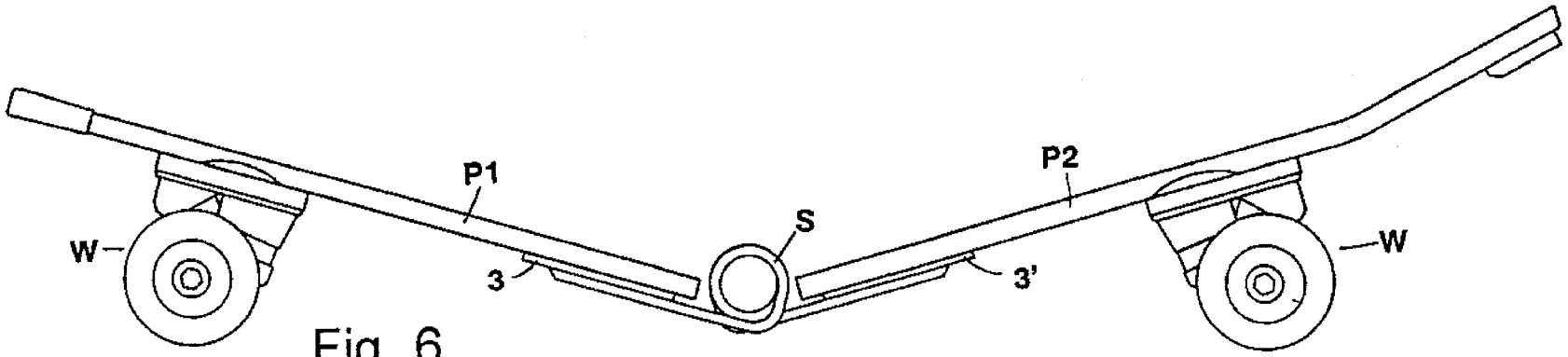
FIG. 6 is a side view of the embodiment of FIG. 5 showing the flex of the board when the spring is stressed under a vertical rider load on the board.
Figure 7:
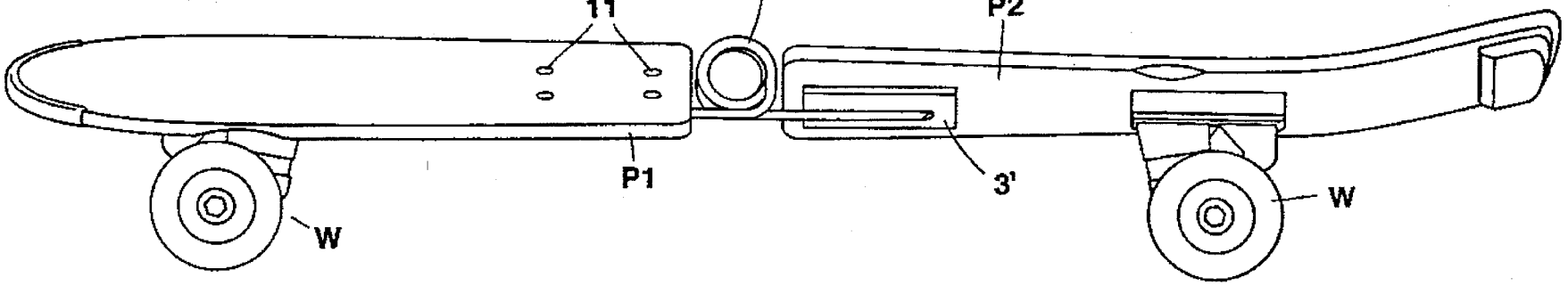
FIG. 7 is a side view of the embodiment of FIG. 5 showing the independent tilting capability of the respective board platforms.
Figure 8:
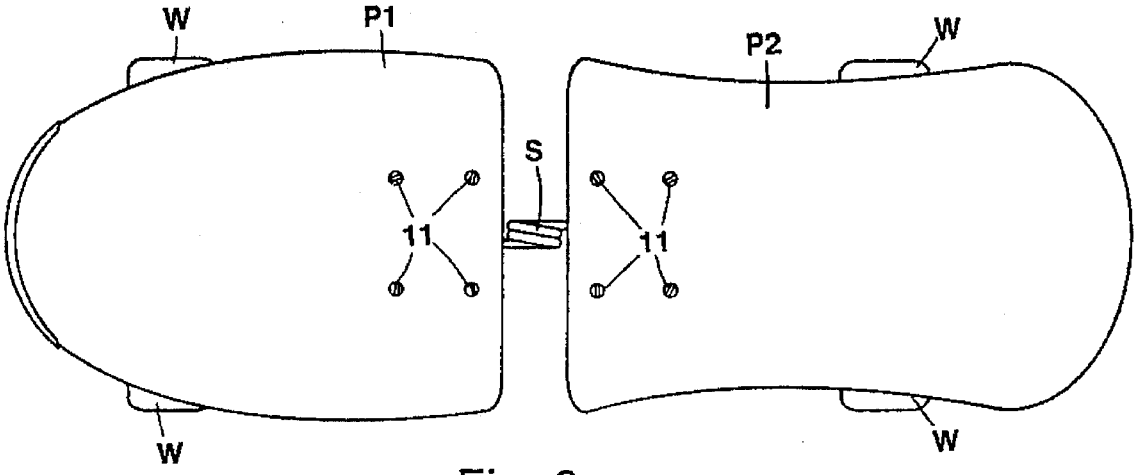
FIG. 8 is a plan view of the skateboard of the embodiment of FIG. 5 in its normal or unstressed configuration with the front of the board to the left side of the figure.
Figure 9:
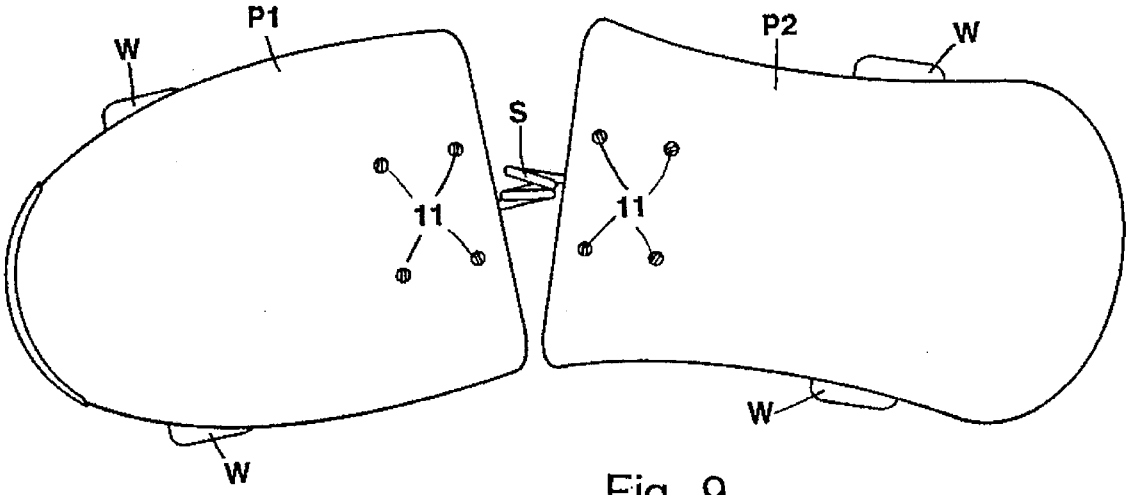
FIG. 9 is a plan view of the embodiment of FIG. 5, similar to FIG. 8, but showing the relative moved positions of the respective relatively stressed board platforms to create a turn to the left.

In a slightly simpler embodiment the platform sections are connected only with a spring assembly S as seen in FIGS. 5–9. In this embodiment the ends of the spring member extend horizontally in opposite directions. Each end of the spring is permanently welded to a broad flat plate 3 or 3' which is attached to a platform section using nut and bolt assemblies 11 or other suitable means. The spring provides essentially universal movement between the respective platforms P1 and P2, allowing flexing movement in a vertical plane as shown in FIG. 6, in a horizontal plane as shown in FIG. 8, or in torsion about a longitudinal axis as shown in FIG. 7. Combinations of these respective movements may also take place.

By varying the diameter or cross section of the rod and the number of coils the spring strength can be controlled. Using a spring steel alloy meeting the specifications of SAE 1095 and the simple coil structure shown in FIG. 5 centered between axles approximately 20 inches apart, results approximating those shown below can be expected. The figure of 3.25 inches of deflection is an arbitrary figure corresponding to a typical height of the bottom of a skateboard platform above a ground surface.

The approximate weight (in pounds) required to deflect the spring 3.25" from an unstressed position such as in FIG. 5 to a stressed position as in FIG. 6 is as follows:

| Number of coil turns | | 1 | 2 |
|---|---|---|---|
| Rod diameter | ¼" (.25") | 100 | 60 |
| | 5/16" (.3125") | 120 | 80 |
| | ⅜" (.375") | 250 | 200 |
| | ½" (.5") | 350 | 300 |

Because of the different modes of actuation of the resilient articulating spring structures, the cross section of the spring rods or coil loops may be made oval or oblong with the major dimension of the cross section being selected and oriented to provide the maximum resistance required, for example, for the resistance to vertical forces of the rider's weight. In such case this major dimension extends radially from the center of the spring coil loops. Conversely, the minor dimension of such cross section would extend parallel to the axis of the respective coil loops to make it easier to deflect the platforms from the positions of FIG. 15A to the positions of FIG. 15B.

Figure 10:
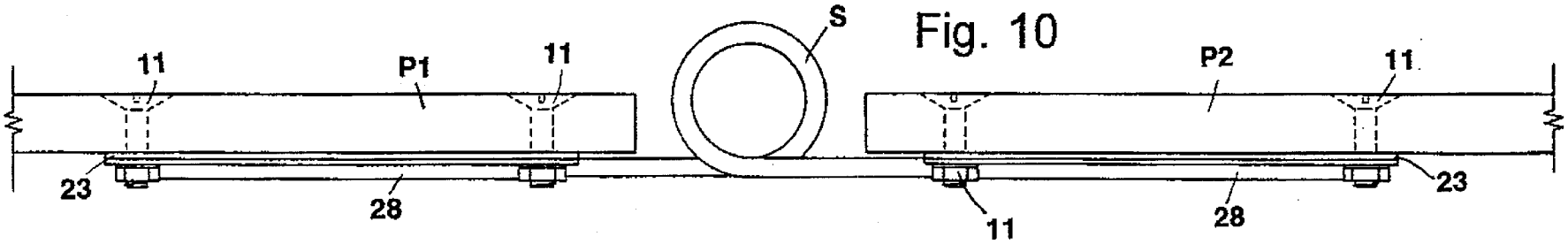
FIG. 10 is a side view of the spring assembly of another alternative embodiment in which each end of an articulating spring assembly is provided with free turning movement about a vertical axis relative to an adjacent platform section through use of a bearing assembly.
Figure 11:
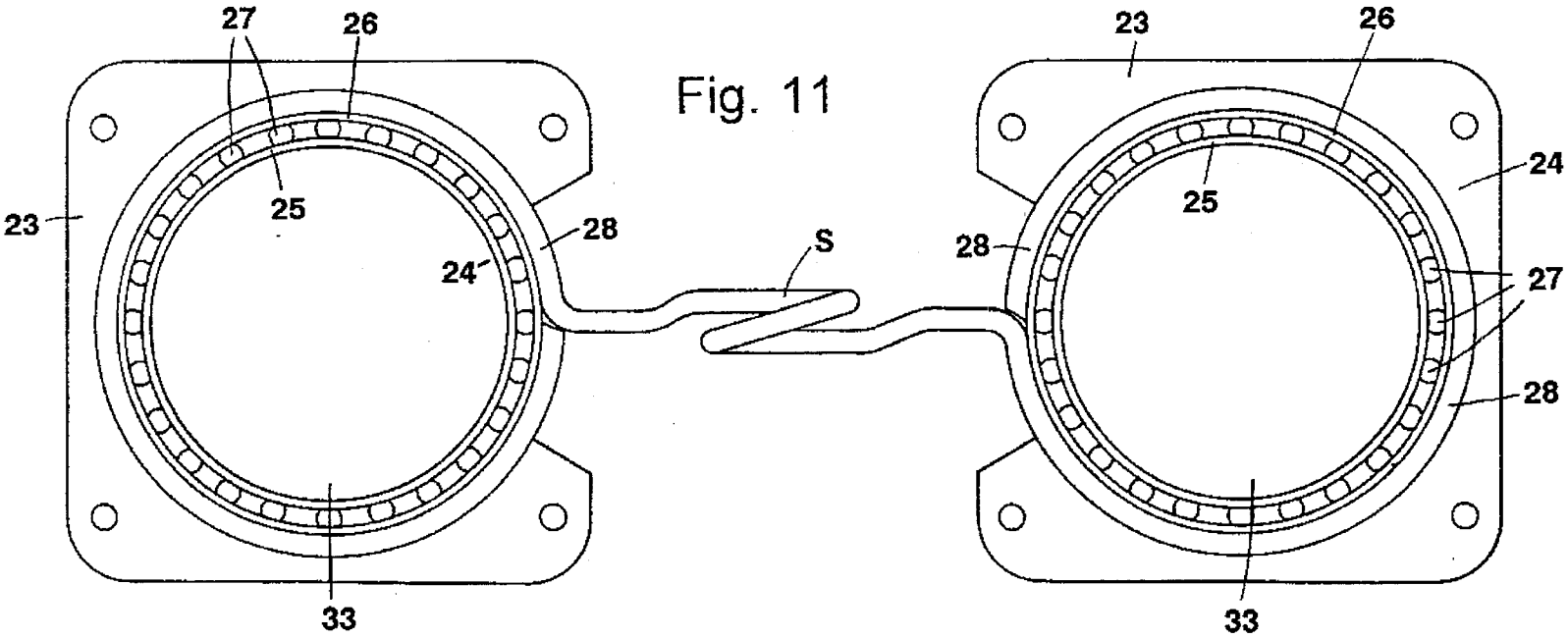
FIG. 11 is a view towards the bottom surface of the alternative embodiment of FIG. 10 showing detail of the bearing assembly.
Figure 12:
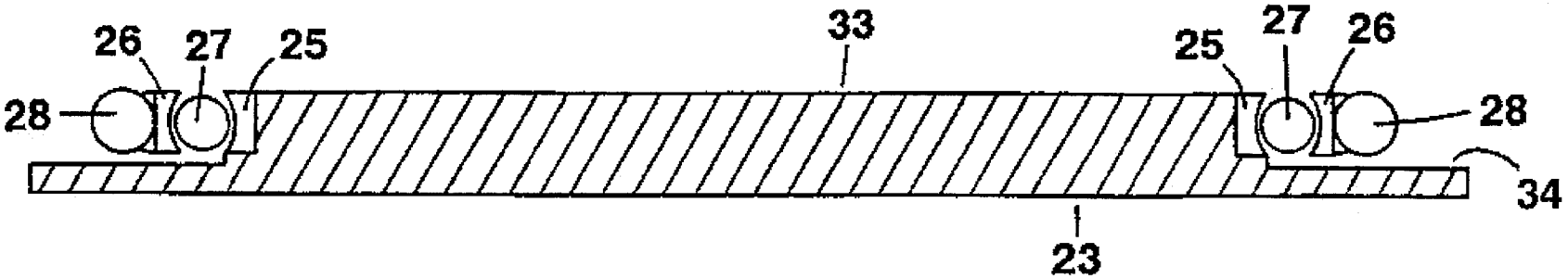
FIG. 12 is a cross section of the spring and bearing assembly of FIG. 11 taken at B—B.

As seen in FIGS. 10–12, a variation of the embodiment of FIGS. 5–9, but still using a coil spring connector S, each platform portion is provided with a greater degree of pivoting movement about a vertical axis by affixing the respective end portions of the spring to ball bearing assemblies mounted on the supporting plates. Each end of the spring S is formed into a loop 28 which is "tack" welded or otherwise attached around the periphery of an outer bearing race of a bearing assembly. As shown, this bearing assembly 24 comprises an inner race 25, an outer race 26, and the ball bearings 27 which lie between the races. The inner race is mounted to a raised portion 33 of a plate 23 and is spaced slightly away from the surface of the unraised portion 34 of the plate 23 so as to allow free rotating movement of the bearing assembly. While a ball bearing assembly is shown as an example, the bearing assembly could be any sort of suitable bearing structure and may even include a simple housing for a flat circular spring loop 28 sandwiched in a plane between two parallel flat low-friction surfaces spaced apart approximately the diameter of the spring rod and confining the circular spring loop to rotation about the center point of the loop.

Figure 13A:
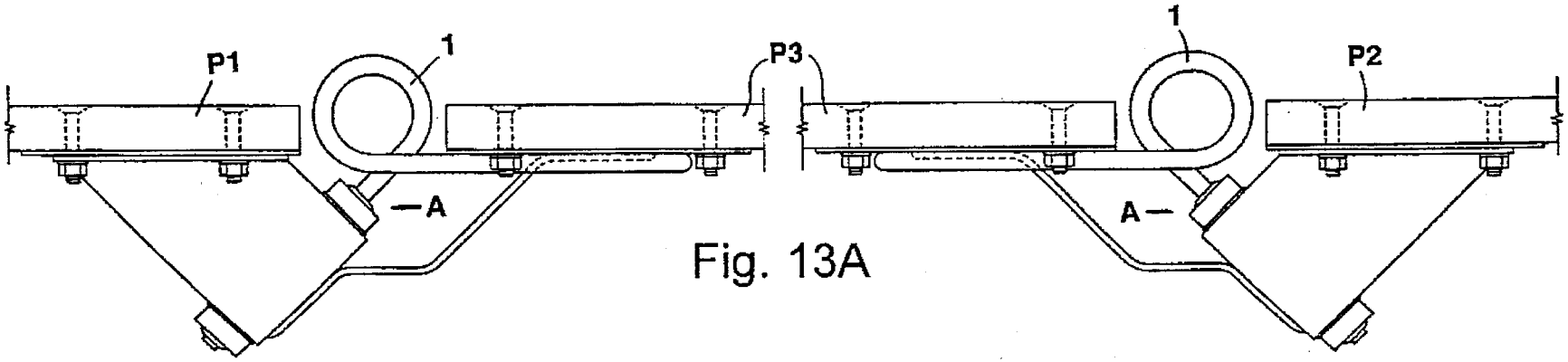
FIG. 13A is a side view of skateboard using two of the articulation assemblies of the preferred embodiment to connect three board platform sections.
Figure 13B:
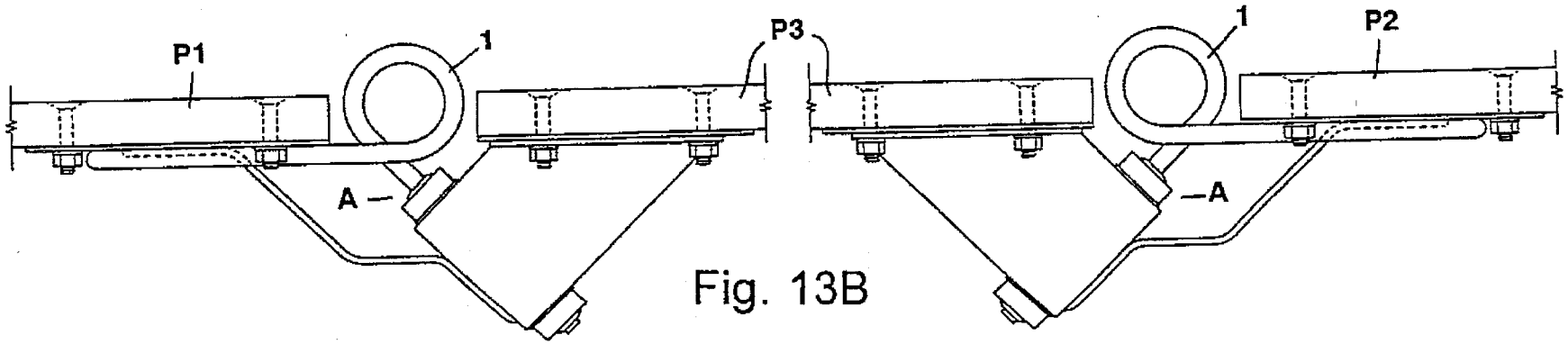
FIG. 13B is view similar to FIG. 13A with each of the articulation assemblies reversed.

In another variation of the preferred embodiment shown in FIGS. 13A and 13B, the board platform assembly comprises two end platform sections P1 and P2 respectively, each of which carries a wheel assembly W, and a center platform section P3, upon which the rider may stand. The respective sections are connected using the spring/pivot structure of the preferred embodiment shown in FIGS. 1 and 2. In essence, the center section P3 is isolated from and suspended between the end sections P1 and P2 by the spring/pivot structures. If the rider stands on the center section all of the rider's weight must be supported by the springs. This may require use of springs with a stronger spring force for vertical support of a rider's weight than those which may be required when a rider's weight is supported primarily over the wheel axles. Because of the isolation of the center section such a structure may be well suited to use on rough surfaces, since the end sections are capable of vertical movement independent of the center section. The springing action may also be better suited to jumping activities since the center platform may remain level at all times, even as the springs are stressed and released.

Figure 14A:
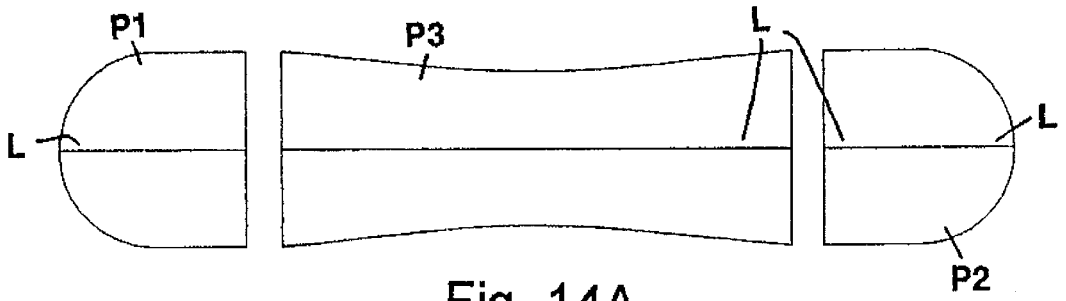
FIG. 14A is a plan view of the variation shown in FIG. 13A, showing the respective board platform sections in a neutral, aligned and unstressed orientation
Figure 14B:
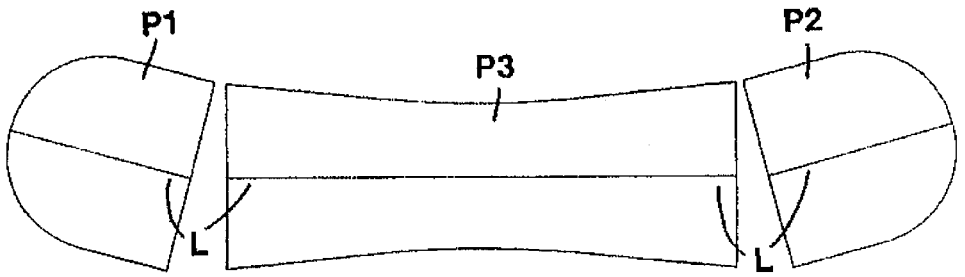
FIG. 14B is a plan view of the variation shown in FIG. 13A, showing the rider-induced or stressed relative steering positions of respective board platform sections.

As shown in FIGS. 14A and 14B, using two spring/pivot structures to connect three platform sections can result in a full steering capability of the respective end platform sections as the center platform section is tilted. Accordingly, the wheel assembly of each such end platform section may be fixed relative to the respective end platform section rather than be steerable as on a conventional skateboard. Although the center section is tilted, each respective platform end section and its corresponding fixed axle may remain parallel to the ground as do the axles of steerable trucks of a standard skateboard as that board is tilted and steered. Alternatively, the spring/pivot structures can be reversed as shown in FIG. 13B to allow the board to be steered by tilting the end portions while the center section remains level. However this variation requires that each wheel axle be tiltable with respect to the board end section to which it is mounted.

The orientation lines L down the centers of the platform sections in FIGS. 15A and 15B are shown angularly disposed relative to a vertical axis near the center of the board, representing respectively left turn and right turn maneuvers. When the rider is not actuating the illustrated platform sections to make a turn, these longitudinal lines of orientation of the platforms are essentially collinear and extend in the same direction as the normal direction of rolling movement when no rider is on the board. For steering movements of the platform sections they are moved generally horizontally about a vertical axis to positions as seen in FIGS. 15A or 15B by the rider's feet. This takes a relatively light horizontal force from the feet as compared with substantially large vertical forces, even exceeding the rider's weight, which may be imposed on the center of the board to store energy in the articulating spring when it is forced by the rider from an unstressed position of FIG. 5 to a position of maximum stress as seen in FIG. 6 during the course of a vertical jumping maneuver.

In each of the embodiments using a spring/pivot structure as part of the articulating means interconnecting the respective platform sections, the articulating means is spaced along the normal direction of rolling movement when no rider is on the board and the wheel axes are parallel. Each of the platform sections attached to an articulating means has securing structure means defining a normal line of orientation which is biased by the articulating means to be parallel to the normal direction of rolling movement and transverse to the axes of the sets of wheels when the wheels are in tracking relationship, moving in the same tracks as in FIG. 8, for example. Although the embodiment of FIGS. 10–12 permits a further pivoting of the respective platform sections about vertical axes normal to the planes of the loops 28, these loops 28 are means for securing the spring S to the platforms and similarly form a means defining a normal line of orientation of the loops 28, extending thereacross from left to right as seen in FIGS. 10–11, which are biased by the articulating means to be parallel to the normal direction of rolling movement and transverse to the axes of the sets of wheels when the wheels are tracking each other with no rider aboard. The articulating means of the different embodiments enable these normal lines of orientation of the platform sections or the loops 28 to be changed by a rider during maneuvering of the skateboard for both directional and jumping maneuvers.

Other variations within the scope of this invention will be apparent from the described embodiment and it is intended that the present descriptions be illustrative of the inventive features encompassed by the appended claims.

What is claimed is:

1. An articulated skateboard having two sets of wheels with each wheel set having wheels rotatable about a respective horizontal axis when the skateboard is resting on a flat horizontal surface, said horizontal axes being parallel to each other and perpendicular to a normal direction of rolling movement of the skateboard with the wheels tracking on said surface when the board is without a rider thereon, said skateboard having platform means for a rider to place his feet on while using the board, said platform means comprising two relatively articulated platform sections, each platform section having a broad area on which the rider can place at least one of his feet, each platform section having one of said wheel sets attached to the under side thereof to provide rolling support during movement of the respective platform section, said skateboard having articulating means interconnecting said platform sections whereby each platform section has means defining a normal line of orientation biased by said articulating means parallel to said normal direction of rolling movement and transverse to the axis of the respective set of wheels during said rolling movement of the respective platform section without a rider on the skateboard, said articulation means being spaced along said normal direction from each wheel set and interconnecting said platform sections to enable a rider to angularly change the directions of said normal lines of orientation of the platform sections with respect to each other during maneuvering of the skateboard.

2. An articulated skateboard according to claim 1 wherein said articulation means includes means for angularly changing, about a vertical axis, the line of orientation of one of said platforms with respect to the line of orientation of the other platform.

3. An articulated skateboard according to claim 1 wherein said articulation means includes means for angularly changing, about a horizontal axis, the line of orientation of one of said platforms with respect to the line of orientation of the other platform.

4. An articulated skateboard according to claim 1 wherein said articulation means includes means for universally changing the angular orientation of the line of orientation of one of said platforms with respect to the line of orientation of the other platform.

5. An articulated skateboard according to claim 2 wherein said articulation means includes spring means interconnecting the platforms.

6. An articulated skateboard according to claim 3 wherein said articulation means includes spring means interconnecting the platforms.

7. An articulated skateboard according to claim 4 wherein said articulation means includes spring means interconnecting the platforms.

8. An articulated skateboard according to claim 7 wherein said spring means interconnecting the platforms has sufficient strength in a vertical direction to prevent portions of the skateboard between the sets of wheels from contacting said surface during maneuvering of the skateboard with a rider thereon.

9. An articulated skateboard according to claim 6 wherein said spring means interconnecting the platforms has sufficient strength in a vertical direction to prevent portions of the skateboard between the sets of wheels from contacting said surface during maneuvering of the skateboard with a rider thereon.

10. An articulated skateboard according to claim 7 wherein said spring means interconnecting the platforms has sufficient strength to prevent portions of the skateboard between the sets of wheels from contacting said surface during maneuvering of the skateboard with a rider thereon.

11. An articulated skateboard according to claim 1 wherein said articulation means includes spring means interconnecting the platforms.

12. An articulated skateboard according to claim 11 wherein said spring means comprises an elongated spring member and including means to secure opposite ends of the spring member to the respective platform sections.

13. An articulated skateboard according to claim 12 wherein said spring means has at least one loop portion with its axis oriented horizontally transversely with respect to said direction of rolling movement of the skateboard.

14. An articulated skateboard according to claim 11 wherein said spring means interconnecting the platforms has multiple modes of resisting deflection, one mode being of sufficient resilient resistance to vertical forces to prevent portions of the skateboard between the sets of wheels from contacting said surface during maneuvering of the skateboard with a rider thereon, another mode being of such different resiliency to enable a rider to use his feet to angularly change about a horizontal axis the line of orientation of one of said platforms with respect to the line of orientation of the other platform to facilitate steering of the skateboard.

15. An articulated skateboard according to claim 1 wherein said articulation means includes a pivoting means having a pivot axis oriented at an angle of about 45 degrees with respect to the horizontal in a vertical plane including said platform lines of orientation when no rider is on the skateboard.

16. An articulated skateboard according to claim 15 wherein said pivoting means includes a fixed portion secured to one of said platform sections and a pivotable portion movable about said pivot axis relative to the fixed portion, and said articulation means further includes a spring means interconnecting said pivotable portion to the other platform section.

17. An articulated skateboard according to claim 9 wherein said spring means has securing means at opposite ends thereof to anchor the respective ends to respective platform sections and providing means at the respective platforms whereby said securing means includes means at each respective platform defining a normal line of orientation which is biased by the articulating means to be parallel to the normal direction of rolling movement and transverse to the axes of the sets of wheels when the wheels are tracking, and whereby the spring means resists rider-weight-induced angular changes, about a horizontal axis, of the line of orientation at one of said platforms with respect to the line of orientation at the other platform, said securing means having anti-friction bearing means between the spring means and at least one of the respective platform sections to facilitate variation by the rider of angular change of at least one of said platforms about a vertical axis to facilitate steering maneuvers of the skateboard.

18. An articulated skateboard according to claim 17 wherein said spring means comprises an elongated spring member having at at least one end a loop secured to a respective platform section, each said bearing means comprises bearing race means and a ring of ball bearings in said race means conforming to said loop.

19. An articulated skateboard having two sets of wheels with each wheel set having wheels rotatable about a respective horizontal axis when the skateboard is resting on a flat horizontal surface, said horizontal axes being parallel to each other and perpendicular to a normal direction of rolling movement of the skateboard with the wheels tracking on said surface when the board is without a rider thereon, said skateboard having multiple platform means for a rider to place his feet on while using the board, said platform means comprising at least two relatively articulated platform sections including two end platform sections, each platform section having a broad area on which the rider can place at least one of his feet, each end platform section having one of said wheel sets attached to the under side thereof to provide rolling support during movement of the respective end platform section, said skateboard having articulating means interconnecting said end platform sections whereby each end platform section has a normal line of orientation biased by said articulating means parallel to said normal direction of rolling movement and transverse to the axis of the respective set of wheels during said rolling movement of the respective platform section without a rider on the skateboard, said articulation means being spaced along said normal direction from each wheel set and comprising spring means flexibly interconnecting said platform sections to enable a rider to angularly change the directions of said normal lines of orientation of the end platform sections with respect to each other during maneuvering of the skateboard.

20. An articulated skateboard according to claim 19 wherein there are three separate platform sections arranged end-to-end.

21. An articulated skateboard having two sets of wheels with each wheel set having wheels rotatable about a respective horizontal axis when the skateboard is resting on a flat horizontal surface, said horizontal axes being parallel to each other and perpendicular to a normal direction of rolling movement of the skateboard on said surface when the board is without a rider thereon, said skateboard having platform means for a rider to place his feet on while using the board, said platform means comprising two relatively articulated separate platform sections each with a primary direction of orientation parallel to said normal direction of rolling skateboard movement, each platform section having a broad area on which the rider can place at least one of his feet, each platform section having one of said wheel sets attached to the under side thereof to provide rolling support during movement of the respective platform section, articulation means interconnecting said platform sections to enable a rider to angularly change the primary direction of one platform section relative to another platform section during maneuvering of the skateboard, said articulation means including a pivoting means having a pivot axis oriented at an angle of about 45 degrees with respect to the horizontal in a vertical plane including said normal direction of rolling movement, said pivoting means including a fixed portion secured to one of said platform sections and a pivotable portion movable about said pivot axis relative to the fixed portion, said articulation means further includes a means interconnecting said pivotable portion to the other platform section.

22. An articulated skateboard according to claim 21 wherein said interconnecting means includes a spring member having at least one loop portion with the axis of the loop oriented horizontally transversely with respect to said direction of rolling movement of the skateboard.

23. An articulated skateboard according to claim 21 wherein said interconnecting means includes a rigid rod having one end coinciding with said pivot axis and forming said pivotable portion with the other end of the rod being connected to said other platform section.

* * * * *